US006279280B1

(12) United States Patent
Plager

(10) Patent No.: US 6,279,280 B1
(45) Date of Patent: Aug. 28, 2001

(54) AESTHETIC SECURITY DOORWAY

(76) Inventor: Wanda Plager, San Pedro, CA (US)

( * ) Notice: Subject to any disclaimer, the term of this patent is extended or adjusted under 35 U.S.C. 154(b) by 0 days.

(21) Appl. No.: 09/439,231

(22) Filed: Nov. 12, 1999

(51) Int. Cl.[7] ..... E06B 1/00

(52) U.S. Cl. ..... 52/311.1; 52/311.2; 52/315; D25/48

(58) Field of Search ..... 52/311.1, 311.2, 52/311.3, 315, 316, 202; D25/47, 48, 50; 49/504

(56) References Cited

U.S. PATENT DOCUMENTS

| | | | | |
|---|---|---|---|---|
| D. 236,201 | * | 8/1975 | Shoush | D25/48 |
| D. 324,427 | | 3/1992 | Chatman . | |
| D. 341,430 | * | 11/1993 | Cardona | D25/53 |
| D. 389,921 | | 1/1998 | Lee . | |
| D. 390,971 | | 2/1998 | Lee . | |
| D. 392,048 | | 3/1998 | Lee . | |
| D. 392,051 | | 3/1998 | Lee . | |
| 549,714 | | 11/1895 | Foster . | |
| 2,766,015 | * | 10/1956 | Farmer | 256/19 |
| 3,267,628 | | 8/1966 | Seery . | |
| 3,621,631 | | 11/1971 | Cutler . | |
| 3,899,860 | | 8/1975 | Newell . | |
| 4,484,410 | | 11/1984 | English . | |
| 4,791,762 | | 12/1988 | Hwang . | |
| 5,003,745 | | 4/1991 | Fang . | |
| 5,123,223 | | 6/1992 | Makarevich et al. . | |
| 5,575,321 | * | 11/1996 | Currier | 160/90 |
| 5,711,125 | | 1/1998 | Schooling . | |
| 5,937,587 | * | 8/1999 | Zinbarg | 52/3 |

* cited by examiner

*Primary Examiner*—Christopher T. Kent
*Assistant Examiner*—Jennifer I. Thissell
(74) *Attorney, Agent, or Firm*—Knobbe Martens Olson & Bear, LLP

(57) ABSTRACT

An aesthetic security doorway is made up of a door with a support structure and a number of crossbars which are shaped and arranged to take on an aesthetically pleasing design, and a doorframe surrounding the door with ornamentation that continues the design of the door onto the doorframe so as to form a unitary decorative image. The crossbars and ornamentation can convey a variety of suitable design themes, such as palm tree branches and fronds, or vines and leaves.

Also disclosed is a method for concealing a security door by arranging a number of crossbars on the door to form a decorative design, and providing ornamentation on the surrounding doorframe to continue the design of the door onto the doorframe.

11 Claims, 3 Drawing Sheets

AESTHETIC SECURITY DOORWAY

BACKGROUND OF THE INVENTION

1. Field of the Invention

This invention relates to a decorative doorway for use on a residential home or other type of building, or with an outdoor fence.

2. Description of the Related Art

Security doors have been used for a number of years to provide additional security for a home, beyond that provided by a conventional door. These doors typically comprise a cage-door-like structure of wrought iron or other suitable metal, hung from the doorway in front of a standard wood or steel "panel" type door. While attempts have been made to enhance the attractiveness of these security doors by adding decor to the bars making up the cage, they nonetheless retain a "tacked-on" appearance, having been designed without regard to the look of the surrounding structure of the home or building to which they are affixed. Furthermore, an observer can easily identify these security doors, as they have a heavy, rectilinear appearance which limits the extent to which the door can blend into the design of the surrounding structure.

Accordingly, there is a need for a security door which has an aesthetically pleasing design that is not easily recognized by an observer as a security device.

SUMMARY OF THE INVENTION

One aspect of the present invention is a doorway which is of sufficiently strong construction to provide the needed security, but which has an aesthetically pleasing design.

Another aspect of the present invention is a security doorway with a door which is not easily identified as a security door by a nearby observer.

An aesthetic security doorway is made up of a door with a support structure and a number of crossbars which are shaped and arranged to take on an aesthetically pleasing design, and a doorframe surrounding the door with ornamentation that continues the design of the door onto the doorframe so as to form a unitary decorative image. The crossbars and ornamentation can convey a variety of suitable design themes, such as palm tree branches and fronds, or vines and leaves.

More generally, the aesthetic security doorway invention is useful for concealing and lending decor to security barriers of various types employed to enclose a structure or land.

The advantages and objects of the invention will become evident from the following detailed description when read in conjunction with the accompanying drawings which illustrate preferred embodiments of the invention.

DETAILED DESCRIPTION OF THE PREFERRED EMBODIMENT

Figure 1:
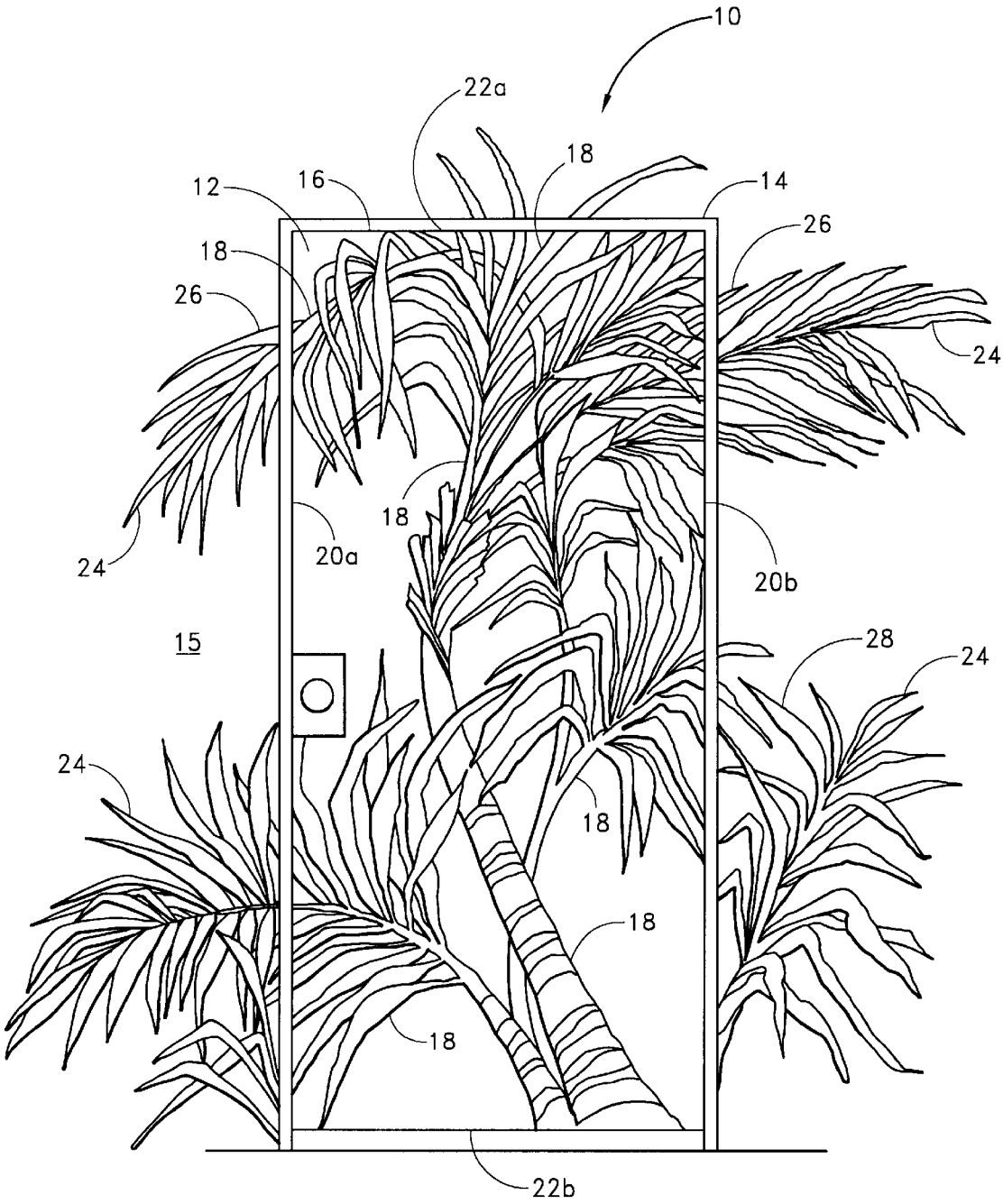
FIG. 1 is an elevation view of one embodiment of an aesthetic security doorway in accordance with the present invention.

FIG. 1 shows an embodiment of an aesthetic security doorway 10 in accordance with the present invention. The doorway 10 comprises a door 12 suspended within a doorframe 14. The doorframe 14 may be integral with a wall 15 of a dwelling or other building, or the doorframe 14 can serve as entryway to a fenced-in outdoor area.

The door 12 comprises a rigid main structure 16 with a plurality of similarly rigid crossbars, cross members or cross pieces 18 attached to the main structure 16. The main structure 16 (shown here schematically) is made up of vertical bars 20*a*, 20*b* and horizontal bars 22*a*, 22*b* joined at the four corners formed thereby. Alternatively, the main structure 16 may comprise a solid panel of wood or metal with crossbars 18 across its outer surface. The main structure 16 is shown in a rectangular shape, but one of skill in the art will recognize that alternative forms are possible such as an arched-top style, with a rounded or arched horizontal bar 22*a*.

Figure 2:
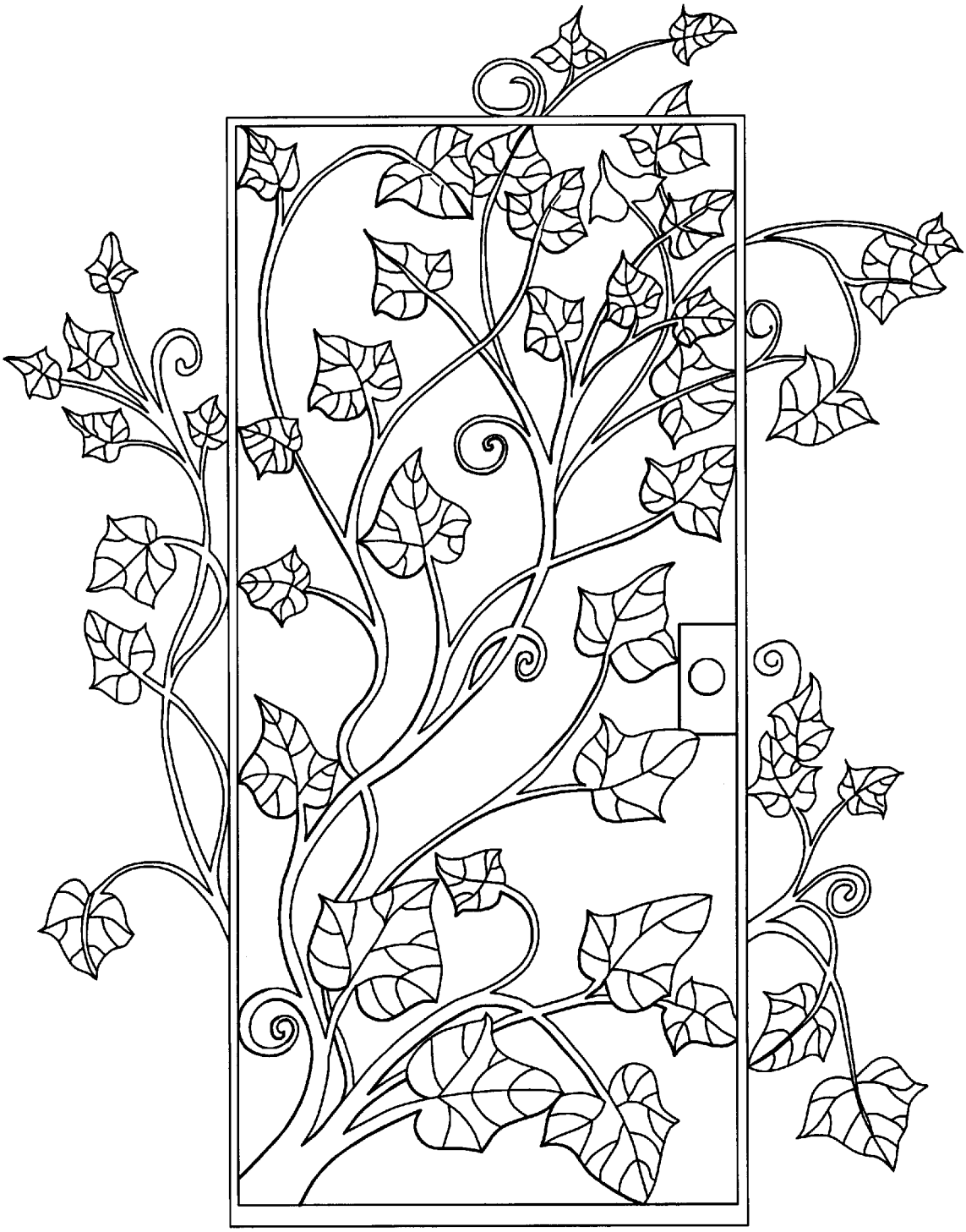
FIG. 2 is an elevation view of another embodiment of an aesthetic security doorway in accordance with the present invention.

Crossbars 18 span the plane of the main structure 16 with the crossbars 18 attached to each other and/or the main structure 16 to form a substantially planar, rigid grill with openings which are small enough to prevent human passage through the door 12. The crossbars 18 are shaped and arranged to create an aesthetically pleasing design for the door 12, such as the palm tree theme shown in FIG. 1, or the vines and leaves shown in FIG. 2. Those familiar with the art can readily envision alternative design themes which lend themselves to use as pattern for the crossbars 18 of the door 12.

The doorframe 14 includes a plurality of decor elements 24 which complement the design formed by the crossbars 18. The decor elements 24 can comprise either extensions 26 of the crossbars 18 beyond the perimeter of the door 16 or they can be independent but complementary elements 28, which carry the design theme onto the doorframe 14 in a different manner. Both types of decor elements 24 cooperate with the design on the door 12 to create a single unitary design which visually blends the door 12 into the doorframe 14. In this manner the otherwise rigid, rectilinear form of the security doorway 10 is obscured, making it difficult for an observer to recognize the door 12 as a security device.

The decor elements 24 may be of lightweight construction so as to be purely decorative, or they may be composed of rigid material so as to reinforce the structure of the doorframe 14 and wall 15, providing additional security.

Figure 3:
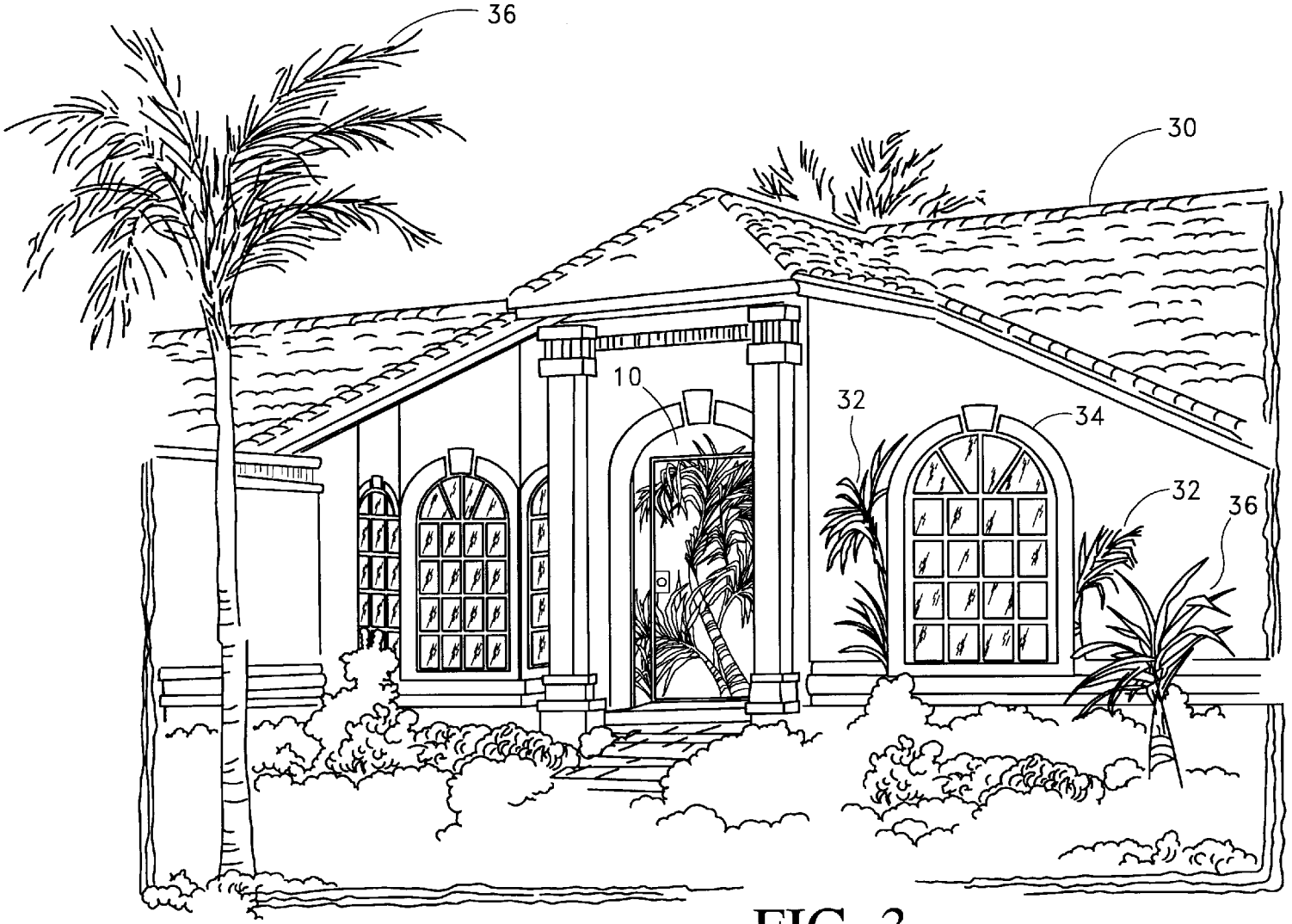
FIG. 3 is a perspective view of the aesthetic security doorway of FIG. 1 installed on a residential home.

FIG. 3 illustrates the use of the security doorway 10 in a residential home 30, from the perspective of an observer on a sidewalk or street. Complementary decor 32 can be added adjacent to windows 34 or other parts of the home 30, or the entryway area, to continue the design theme throughout the exterior of the home 30. Furthermore, the design can be chosen to match or reflect the elements of the landscape 36 surrounding the home 30.

Naturally, one of skill in the art will recognize the invention is not limited to use with doorways; rather, it is equally suitable for use on windows or other passageways associated with the enclosure of buildings or land.

It should be understood that the scope of the present invention is not to be limited by the illustrations or the foregoing description thereof, but rather by the appended claims, and certain variations and modifications of this invention will suggest themselves to one of ordinary skill in the art.

What is claimed is:

1. A decorative security door system, comprising:

a door, comprising:

a generally planar support structure; and a plurality of cross members connected to the support structure, the cross members being shaped and arranged to form an aesthetically pleasing design; and a doorframe surrounding the door, the doorframe having ornamentation which continues and complements the design formed by the cross members.

2. The system of claim 1, wherein the ornamentation and the cross members combine to form a unitary decorative image.

3. The system of claim 1, wherein the cross members extend to at least one edge of the door, and the ornamentation appears to be a continuation of the cross members onto the doorframe.

4. The system of claim 1, wherein the ornamentation is shaped and arranged in a similar decorative manner as the cross members.

5. The system of claim 1, wherein the cross members and the ornamentation are shaped to resemble vines and leaves.

6. The system of claim 1, wherein the cross members and the ornamentation are shaped to resemble palm tree branches and palm fronds.

7. A protective barrier system, comprising:

a barrier, the barrier comprising:

a generally planar support frame; and a plurality of cross pieces connected to the support frame, the cross pieces being shaped and arranged to form an aesthetically pleasing design; and a barrier frame surrounding the barrier, the barrier frame having decorative elements which extend the design formed by the cross pieces onto the barrier frame.

8. A method for concealing a security do or mounted in a surrounding doorframe, comprising the steps of:

providing a plurality of cross members attached to the door;

arranging the cross members to form a decorative design; and providing ornamentation on the doorframe, the ornamentation being a continuation of the design formed by the cross members.

9. A decorative security door system, comprising:

a door, comprising:

a generally planar support structure; and a plurality of cross members connected to the support structure, the cross members being shaped and arranged to form a first portion of an image; and a doorframe surrounding the door, the doorframe having ornamentation which forms a second portion of said image, so that the perimeter of said door is obscured by said image.

10. A decorative security door system, comprising:

a door, comprising:

a generally planar support structure; and a plurality of cross members connected to the support structure; and a wall surrounding the door, the wall having ornamentation;

wherein said cross members and said ornamentation form an image which tends to conceal the perimeter of said door.

11. A method for concealing a security door mounted in a surrounding doorframe, comprising the steps of:

attaching a plurality of cross members to the door;

arranging the cross members to form a first portion of an image; and providing ornamentation on the doorframe, the ornamentation forming a second portion of said image, so that said image tends to conceal the overall shape of said door.

* * * * *